US005290180A

United States Patent [19]

Herrmann

[11] Patent Number: 5,290,180

[45] Date of Patent: Mar. 1, 1994

[54] SERIAL LINE CONNECTOR

[75] Inventor: Johann Herrmann, Mallersdorf-Pfaffenberg, Fed. Rep. of Germany

[73] Assignee: Siemens Aktiengesellschaft, Munich, Fed. Rep. of Germany

[21] Appl. No.: 959,186

[22] Filed: Oct. 9, 1992

[30] Foreign Application Priority Data

Oct. 11, 1991 [EP] European Pat. Off. ..... 91117417.5

[51] Int. Cl.[5] ..... H01R 9/26

[52] U.S. Cl. ..... 439/716

[58] Field of Search ..... 439/709-719

[56] References Cited

U.S. PATENT DOCUMENTS

| | | | |
|---|---|---|---|
| 3,729,657 | 4/1973 | Callan et al. | 439/712 |
| 3,833,839 | 9/1974 | Debaigt | 439/76 |
| 4,768,961 | 9/1988 | Lau | 439/490 |

FOREIGN PATENT DOCUMENTS

| | | | |
|---|---|---|---|
| 0369916 | 5/1990 | European Pat. Off. . | |
| 1280958 | 10/1968 | Fed. Rep. of Germany | 439/716 |
| 1440132 | 10/1968 | Fed. Rep. of Germany . | |
| 2119949 | 7/1975 | Fed. Rep. of Germany . | |
| 2450228 | 5/1976 | Fed. Rep. of Germany | 439/716 |
| 2515711 | 8/1976 | Fed. Rep. of Germany . | |
| 2722736 | 4/1982 | Fed. Rep. of Germany . | |
| 3629796 | 12/1987 | Fed. Rep. of Germany . | |
| 3704784 | 5/1988 | Fed. Rep. of Germany . | |
| 3732650 | 4/1989 | Fed. Rep. of Germany . | |
| 9000143.5 | 4/1990 | Fed. Rep. of Germany . | |
| 2164003 | 7/1973 | France . | |
| 2166914 | 5/1986 | United Kingdom | 439/716 |

*Primary Examiner*—Neil Abrams
*Attorney, Agent, or Firm*—Kenyon & Kenyon

[57] ABSTRACT

Serial line connector which has first connectors 1 for a series of lines, including, for example, at least one for signal transmitters and one for a power network. The first connectors 1 are coupled with second connectors 3, by an intermediary circuit board 4. The second connectors 3 could be, for example, signal receivers. Other connectors are structured to form cross-connectors 10 to other serial line connectors. These cross-connectors are arranged as bus bars fixed in an assembly rail. These connectors are connected by leads 16 with those first connectors 1 that are not coupled to the second connectors 3. The serial line connector is suitable as an initiator terminal.

13 Claims, 3 Drawing Sheets

SERIAL LINE CONNECTOR

BACKGROUND OF THE INVENTION

The present invention relates to a serial line connector. More particularly, the present invention relates to a device which simplifies the wiring of initiators to actors. Initiators can be signal transmitters, for example proximity switches, sensors or command emitters. Actors can be signal receivers that activate or initiate further activity when a signal is received. Examples include solenoid valves, relays, or other signal-processing elements. In the serial terminal technique, some serial terminals can be used simply to pass signals through the device, and other serial terminals can be connected via bus bars which serve to power on-board electrical systems.

German Patent No. DE-B-21 19 949 describes plug-in adapters for connecting pole-dependent electrical modules. These connect first connectors with second connectors via a circuit board, for example a dialing keypad in telephone equipment. German Application No. DE-U-9 000 143 describes the attachment of ribbon cables to individual serial terminals, without a cross-connector. Similarly, German Patent No. DE-C-2 722 736 describes the connection of multiplex plugs to terminals of a terminal strip via a circuit board. Cross-connectors as such are commonly used in serial terminals (for example German Patent No. DE-C-2 515 711).

A compact construction and high density of connections can be achieved by arranging the first connectors in one connection plane. This particular embodiment is described in German Patent No. DE-A-1 440 132.

The arrangement of cross-connectors as bus bars in an assembly rail is also known from building system technology as described by German Patent No. DE-A-3 732 650.

German Patent No. DE-C-3 629 796 describes a vertical arrangement of first connectors on an assembly rail. This increases their accessibility from the side, and allows their connection to terminals from above to occur without crossing.

There is a need for a serial line connector which can link the two types of paths in a clear and economically efficient manner. In addition to simplicity of layout, a modular approach is needed. In this manner, any components which are not required can be left out. Similarly a variety of interfaces for the connections can be inserted. This allows the adaptation of the device to solve multiple problems in connection technology.

SUMMARY OF THE INVENTION

These and other needs are satisfied by the device of the present invention for a serial line connector. According to the present invention, the serial line connector has first connectors for a series of lines, which could be, for example, one for a signal transmitter and one for a power network. The first connectors are connected with second connectors by the intermediary circuit board. The second connectors could be signal receivers, for example. The serial line connector also has cross-connectors coupled between the second connectors and other serial line connectors. These cross-connectors are coupled with those first connectors which are not connected with the second connectors. This allows the bundling of signals in a first type of path, via the circuit board, and their update, processing, or arrangement, if necessary. Furthermore, a second type of path is available, which allows through connections and parallel connections to be constructed in a clear manner.

The first connectors lay in a single connection plane, for compact construction and a high density of connections. The second connectors can be bundled in a cable.

The cross-connectors are arranged as bus bars in an assembly rail. In particular, the bus bars are arranged inclined in the assembly rail, particularly at a right angle, to an imaginary assembly plane, where the imaginary assembly plane is the plane which contains all of the cross-connectors but which is perpendicular to the plane of the page. The connectors are then structured in a fork-shaped manner. Each such fork tine can, in turn, be structured with several arms, so that several contact points are established. In this connection, it is advantageous to structure a holder for the bus bars that can snap onto the assembly rail. When setting the serial line connector into place, a cross-connection is then made at the same time.

The serial line connector is structured in a modular manner, so that any unneeded components can be removed. The separate circuit board component is mechanically and electrically connected with the first connectors and the connectors to the cross-connectors within the base component. The circuit board component is structured in such a way that a plug with contacts for second connectors can be inserted. Other interfaces can also be selected.

The first connectors can be arranged above one another on an assembly rail vertically with respect to an imaginary assembly plane, where the imaginary assembly plane is the plane which contains the cross-connectors but which is perpendicular to the plane of the page. This increases their accessibility from the side, and allows their connection to terminals above to occur without crossing. Such an arrangement can be advantageously used in the device shown in German Patent No. DE-C-3 629 796.

The accessibility to the first connectors can be further increased, and the area for connections to be housed can be enlarged, if the first connectors are arranged on an assembly rail inclined at an angle relative to the imaginary assembly plane, where the imaginary assembly plane is the plane which contains the first connectors but which is perpendicular to the plane of the page.

The contact to cross-connectors can be achieved in a variety of ways. A simple structure is achieved if connecting leads between the first connectors and the cross-connectors are structured in stirrup shape and angled in such a manner that they form spring-type connectors to the cross-connectors with their free ends.

DETAILED DESCRIPTION

Figure 1:
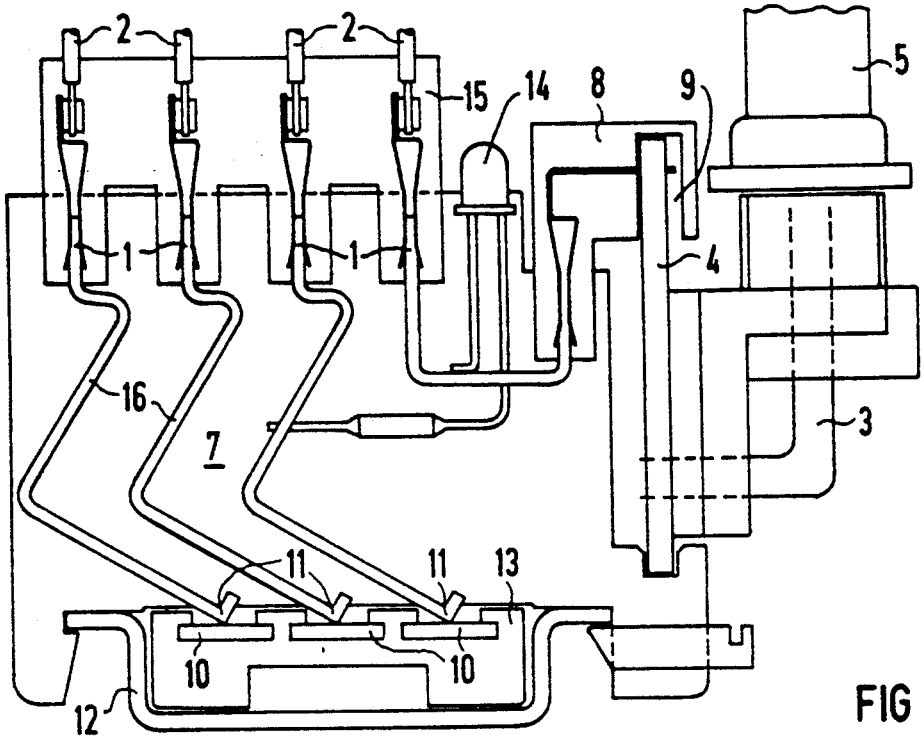
FIG. 1 is a serial line connector pursuant to a first embodiment.

The serial line connector shown in FIG. 1 has first connectors 1 for a series of lines 2 and second connectors 3. In this embodiment, a first connector (e.g., the first connector on the far right), is connected with a particular second connector 3 in a bundle of second connectors 3, by an intermediary circuit board 4. A bundle plug 5 can be connected to the second connectors 3. The circuit board 4 can extend over several base components in series, with connectors 1 and connectors 11 forming cross-connectors. It brings the lines from each base component 7 together and bundles them. In this connection, signals can also be updated, processed or arranged by the circuit board. It is advantageous to provide a separate circuit board component 8 for each base component 7, which holds the circuit board 4 jointly with a guide 9 in the base component 7. The circuit board 4 has two second connectors 3 which lead to bundle plug 5. A suitable intermediate piece can also be used in place of the two second connectors 3.

Connectors 11 contact bus-bar cross-connectors 10. Any first connectors 1 which are not connected with second connectors 3 are connected with connectors 11, to form cross-connectors. The cross-connectors are held as bus bars in an assembly rail 12 with an insulation element 13.

Optical display, light emitting diode 14 monitors the signal line from first connector 1 to second connector 3. The optical display responds to the potential difference between the signal line corresponding to one of the first connectors which is connected to the circuit board, and a line between another first connector 1 coupled to cross-connector 10. In this way, it is possible to check and/or indicate whether or not a signal transmitter has responded.

In the embodiment, the first connectors 1 are implemented as pin contacts within a socket contact and are resilient; these contacts are crimped onto lines 2.

In the embodiment pursuant to FIG. 1, connector leads 16 between the first connectors 1 and the cross-connectors 10 are structured in stirrup shape and angled in such a way that they form spring-type connectors 11 to the cross-connectors with their free ends.

Socket-type plug elements are arranged in a plug component 15, which can be plugged onto the first connectors 1. A corresponding contact is placed in the circuit board component 8. Circuit board 4, when placed into guide 9, forms an electrical contact between second connectors 3 and first connectors 1 via stirrup 17.

The first connectors 1 for a series of lines are arranged in a first connection plane. The connection planes of serial line connectors in series are arranged above and below the plane of the drawing.

Figure 2:
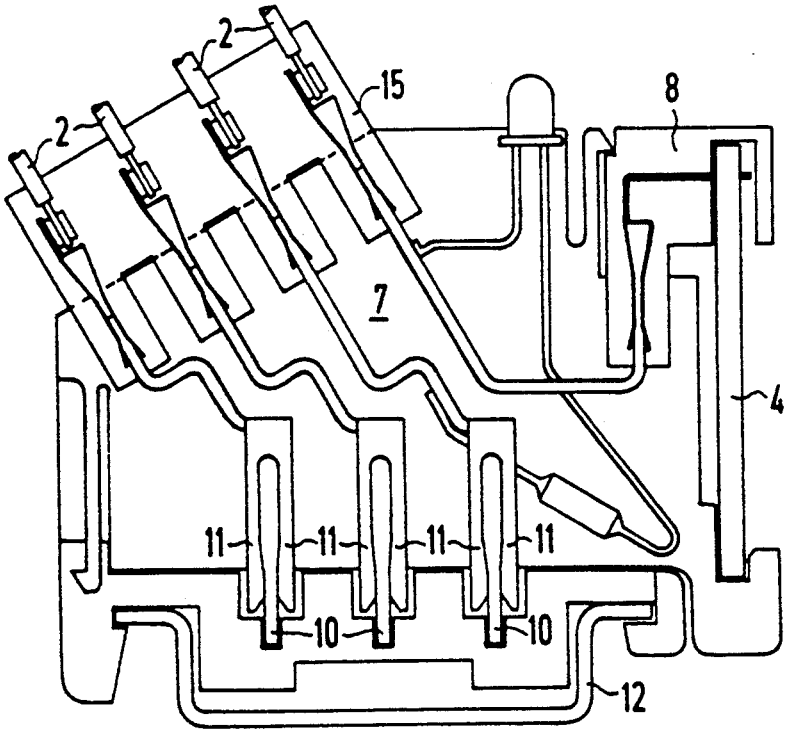
FIG. 2 is another embodiment for a serial line connector which demonstrates a different interface from that of FIG. 1.

In the serial line connector of FIG. 2, the bus bar cross-connectors 10 are arranged in the assembly rail 12 for mechanically holding the serial line connector. The hold is provided in a known manner for serial terminals. The cross-connectors 10 are inclined relative to an imaginary assembly plane, where the imaginary assembly plane is the plane which contains all of the cross-connectors but which is perpendicular to the plane of the page (at a right angle in this embodiment). The connectors 11 for this are structured in a fork shape, where each fork tine can in turn consist of several tines, in order to adjust the contact force and power carrying capacity in a desired manner.

The first connectors 1 are arranged on the assembly rail 12 at an angle relative to an imaginary assembly plane, where the imaginary assembly plane is the plane which contains the first connectors but which is perpendicular to the plane of the page. This promotes lateral accessibility, and the surface for housing first connectors is enlarged.

Figure 3:
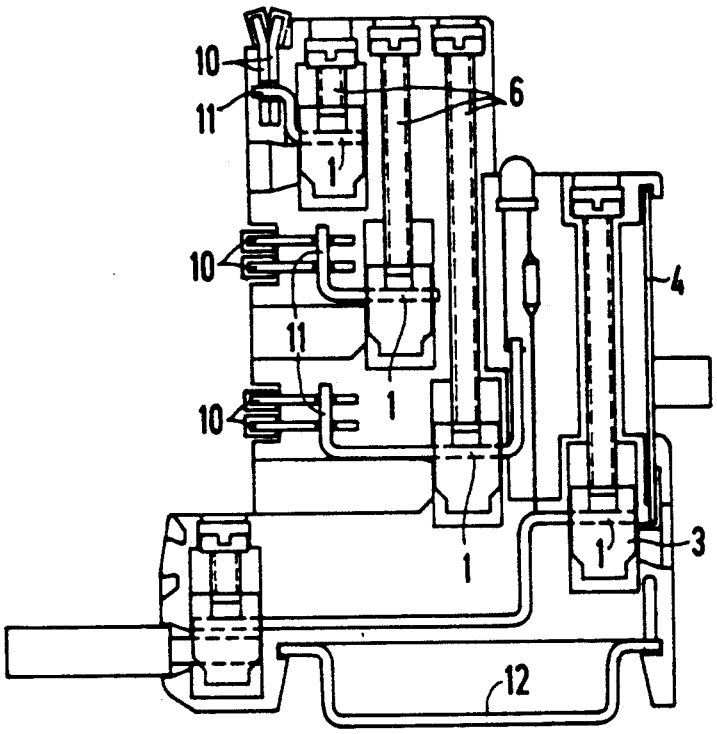
FIG. 3 illustrates another embodiment, where the second connectors are similar to those in FIG. 2.

Referring to FIG. 3, the first connectors 1 are arranged above one another on an assembly rail, relative to an imaginary assembly plane, where the imaginary assembly plane is the plane which contains the cross-connectors but which is perpendicular to the plane of the page. They are then laterally accessible. Cross-connectors 10 and their connection terminals 6 above are then staggered and do not cross. When the connection terminal is tightened in each case, a connection is made. The upper three cross-connectors 10 are illustrated in an overlapping region of an extension in the embodiment. The topmost first connector 1, for example, can be used as a PE conductor. The next connector underneath could be used for the negative potential of an on-board electrical system. The bottom connector could be used as a signal conductor to connect to a signal transmitter. The second connector 3, which has a conductive connection with the circuit board 4, can be used for passing the signal on to a signal receiver. In this connection, the circuit board 4 can bring the signal paths together in serial line connectors which are in series.

Figure 4:
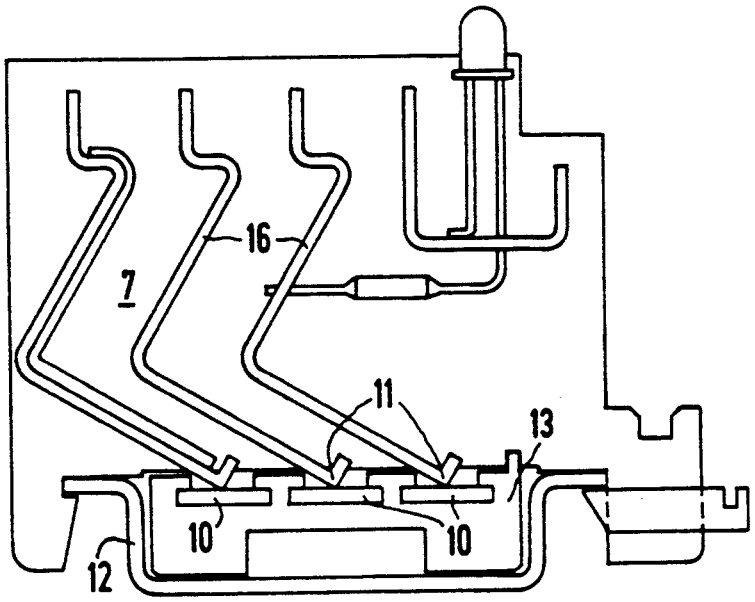
FIG. 4 is a base component, for example, for a structure pursuant to FIG. 1.
Figure 5:
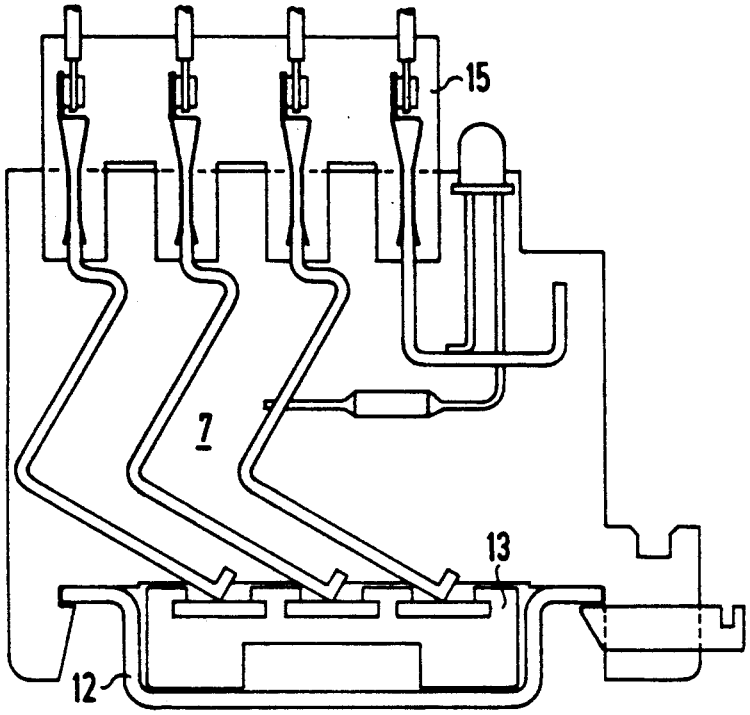
FIG. 5 is a base component equipped with first connectors, otherwise corresponding to that of FIG. 4.

In FIG. 5, a base component 7 is shown together with a plug component 15, as in the embodiment of FIG. 1. This base component 7 can also be used independently and is diagrammed as such in FIG. 4.

Figure 6:
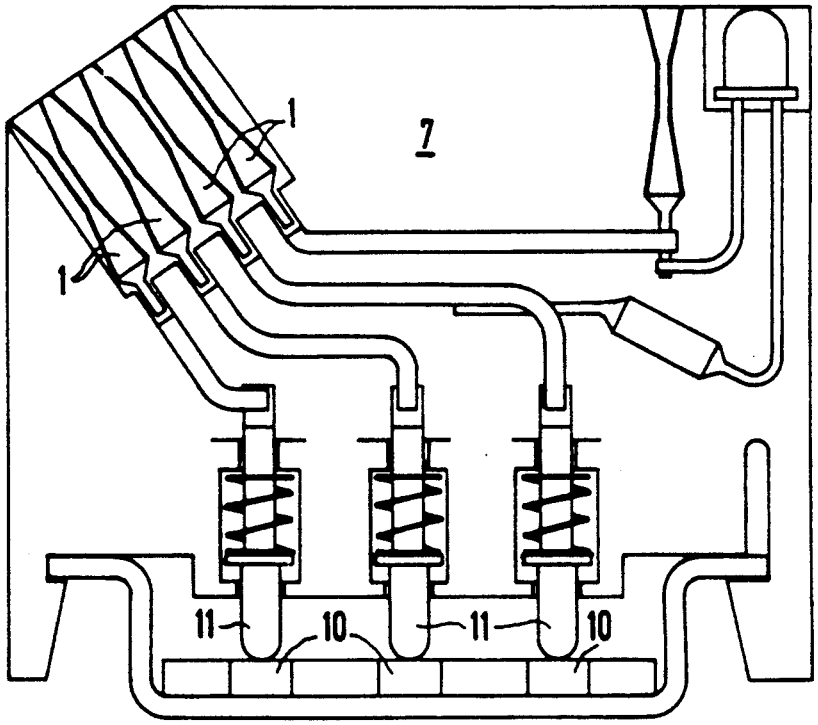
FIG. 6 illustrates another embodiment for a base component.

FIG. 6 shows another embodiment for the base component 7. In this embodiment, the connectors 11 are structured as resilient pin contacts, and form an electrical contact with cross-connectors 10. The first connectors 1 are socket contacts soldered onto conductors. When used as an initiator terminal, pin-shaped contacts of signal transmitters can be introduced.

What is claimed is:

1. A serial line connector, comprising:

a circuit board;

a plurality of first connectors coupled to a series of lines;

at least one second connector coupled to at least one of said plurality of first connectors via said circuit board;

at least one connecting lead coupled to at least one of said plurality of first connectors;

a cross-connector coupled between said at least one connecting lead and at least one additional serial line connector; and such that said at least one connecting lead is coupled to one of said plurality of first connectors that is not coupled to said at least one second connector.

2. The serial line connector of claim 1, wherein said plurality of first connectors are coupled to at least one signal transmitter and at least one power network via said series of lines.

3. The serial line connector of claim 2, wherein said at least one second connectors is a signal receiver.

4. The serial line connector of claim 3, wherein said plurality of first connectors lies in a single connection plane.

5. The serial line connector of claim 3, wherein said at least one second connecter is coupled within a bundle coupled within a bundle.

6. The serial line connector of claim 3, wherein said plurality of cross-connectors are arranged in an assembly rail as bus bars.

7. The serial line connector of claim 6, wherein said bus bars are arranged inclined in said assembly rail in a holder at an angle to an imaginary assembly plane.

8. The serial line connector of claim 7, wherein said at least one third connector has a fork-shaped surrounding structure, such that said holder is capable of being snapped onto said assembly rail.

9. The serial line connector of claim 3, wherein said circuit board is arranged as a separate component capable of being mechanically and electrically coupled to said plurality of first connectors.

10. The serial line connector of claim 9, further comprising a bundle plug having a plurality of contacts capable of being coupled to said plurality of second connectors, said bundle plug being plugged into said circuit board.

11. The serial line connector of claim 3, wherein said plurality of first connectors are arranged vertically on an assembly rail, said plurality of first connectors being accessible from a side of said serial line connector, said plurality of first connectors capable of being electrically coupled to said cross-connectors, said serial line connector further comprising a plurality of vertical connection terminals coupled to said plurality of first connectors, said plurality of vertical connections providing access to said plurality of first connectors from above said serial line connector.

12. The serial line connector of claim 3, wherein said plurality of first connectors are inclined, on said assembly rail, at an angle relative to an imaginary assembly plane, where the imaginary assembly plane is the plane which contains the first connectors but which is perpendicular to the plane of the page.

13. The serial line connector of claim 3, wherein said third connectors have a stirrup shape with a free end, said third connectors being angled such that said free end forms at least one spring-type connection to said cross-connectors.

* * * * *